US006666749B2

(12) United States Patent
Taylor

(10) Patent No.: US 6,666,749 B2
(45) Date of Patent: Dec. 23, 2003

(54) APPARATUS AND METHOD FOR ENHANCED PROCESSING OF MICROELECTRONIC WORKPIECES

(75) Inventor: Theodore M. Taylor, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 85 days.

(21) Appl. No.: 09/944,726

(22) Filed: Aug. 30, 2001

(65) Prior Publication Data

US 2003/0045207 A1 Mar. 6, 2003

(51) Int. Cl.[7] ..... B24B 49/00

(52) U.S. Cl. ..... 451/6; 451/5; 451/8; 451/10; 451/11; 451/41; 451/67; 451/72; 451/285; 451/286; 451/287; 451/910

(58) Field of Search ..... 451/5, 6, 8, 10, 451/11, 41, 61, 72, 285, 286, 287, 910

(56) References Cited

U.S. PATENT DOCUMENTS 5,020,283 A 6/1991 Tuttle
5,036,015 A 7/1991 Sandhu et al.
5,069,002 A 12/1991 Sandhu et al.
5,196,353 A 3/1993 Sandhu et al.
5,222,329 A 6/1993 Yu
5,232,875 A 8/1993 Tuttle et al.
5,240,552 A 8/1993 Yu et al.
5,244,534 A 9/1993 Yu et al.
5,245,790 A 9/1993 Jerbic
5,245,796 A * 9/1993 Miller et al. ..... 451/41
5,314,843 A 5/1994 Yu et al.
5,433,651 A 7/1995 Lustig et al.
5,449,314 A 9/1995 Meikle et al.
5,486,129 A 1/1996 Sandhu et al.
5,514,245 A 5/1996 Doan et al.
5,540,810 A 7/1996 Sandhu et al.
5,609,718 A 3/1997 Meikle
5,616,069 A 4/1997 Walker et al.
5,618,381 A 4/1997 Doan et al.
5,624,303 A 4/1997 Robinson
5,643,048 A 7/1997 Iyer
5,645,682 A 7/1997 Skrovan
5,650,619 A 7/1997 Hudson
5,655,951 A 8/1997 Meikle et al.
5,658,190 A 8/1997 Wright et al.
5,663,797 A 9/1997 Sandhu
5,679,065 A 10/1997 Henderson
5,681,423 A 10/1997 Sandhu et al.
5,690,540 A 11/1997 Elliott et al.

(List continued on next page.)

*Primary Examiner*—Joseph J. Hail, III
*Assistant Examiner*—Shantese McDonald
(74) *Attorney, Agent, or Firm*—Perkins Coie LLP

(57) ABSTRACT

Chemical-mechanical planarizing machines and methods to maintain processing pads and other planarizing media used in planarizing microelectronic workpieces. In one embodiment, a planarizing machine can include a surfacing device attached to one of a carrier or a support member. The surfacing device is positioned to transmit a non-abrasive energy, such as ultrasonic waves, against the planarizing medium. The planarizing machine can include a controller that is operatively coupled to the surfacing device for activating the surfacing device at appropriate moments either before or during a planarizing cycle of a microelectronic workpiece. In another embodiment the controller can be a computer having a database containing instructions for causing the surfacing device to transmit the non-abrasive energy against the planarizing pad. In another aspect of the invention, a method for planarizing a microelectronic workpiece includes monitoring the planarity of the workpiece and causing the surfacing device to transmit energy to the planarizing pad upon an indication that the workpiece surface is at least approximately planar.

52 Claims, 7 Drawing Sheets

U.S. PATENT DOCUMENTS 5,698,455 A 12/1997 Meikle et al.
5,702,292 A 12/1997 Brunelli et al.
5,725,417 A 3/1998 Robinson
5,736,427 A 4/1998 Henderson
5,738,567 A 4/1998 Manzonie et al.
5,747,386 A 5/1998 Moore
5,779,522 A 7/1998 Walker et al.
5,782,675 A 7/1998 Southwick
5,792,709 A 8/1998 Robinson et al.
5,795,218 A 8/1998 Doan et al.
5,795,495 A 8/1998 Meikle
5,798,302 A 8/1998 Hudson et al.
5,801,066 A 9/1998 Meikle
5,823,855 A 10/1998 Robinson
5,830,806 A 11/1998 Hudson et al.
5,846,336 A 12/1998 Skrovan
5,855,804 A 1/1999 Walker
5,868,896 A 2/1999 Robinson et al.
5,871,392 A 2/1999 Meikle et al.
5,879,222 A 3/1999 Robinson
5,879,226 A 3/1999 Robinson
5,882,248 A 3/1999 Wright et al.
5,893,754 A 4/1999 Robinson et al.
5,894,852 A 4/1999 Gonzales et al.
5,895,550 A 4/1999 Andreas
5,910,043 A 6/1999 Manzonie et al.
5,910,846 A 6/1999 Sandhu
5,934,980 A 8/1999 Koos et al.
5,938,801 A 8/1999 Robinson
5,954,912 A 9/1999 Moore
5,972,792 A 10/1999 Hudson
5,976,000 A 11/1999 Hudson
5,980,363 A 11/1999 Meikle et al.
5,981,396 A 11/1999 Robinson et al.
5,989,470 A 11/1999 Doan et al.
5,994,224 A 11/1999 Sandhu et al.
5,997,384 A 12/1999 Blalock
6,036,586 A 3/2000 Ward
6,039,633 A 3/2000 Chopra
6,040,245 A 3/2000 Sandhu et al.
6,046,111 A 4/2000 Robinson
6,054,015 A 4/2000 Brunelli et al.
6,057,602 A 5/2000 Hudson et al.
6,077,785 A 6/2000 Andreas
6,083,085 A 7/2000 Lankford
6,106,351 A 8/2000 Raina et al.
6,108,092 A 8/2000 Sandhu
6,110,820 A 8/2000 Sandhu et al.
6,114,706 A 9/2000 Meikle et al.
6,120,354 A 9/2000 Koos et al.
6,124,207 A 9/2000 Robinson et al.
6,139,402 A 10/2000 Moore
6,143,123 A 11/2000 Robinson et al.
6,186,870 B1 2/2001 Wright et al.
6,187,681 B1 2/2001 Moore
6,190,494 B1 2/2001 Dow
6,191,037 B1 2/2001 Robinson et al.
6,191,864 B1 2/2001 Sandhu
6,200,901 B1 3/2001 Hudson et al.
6,203,407 B1 3/2001 Robinson
6,203,413 B1 3/2001 Skrovan
6,206,754 B1 3/2001 Moore
6,206,759 B1 3/2001 Agarwal et al.
6,206,769 B1 3/2001 Walker
6,210,257 B1 4/2001 Carlson
6,213,845 B1 4/2001 Elledge
6,227,955 B1 5/2001 Custer et al.
6,234,877 B1 5/2001 Koos et al.
6,234,878 B1 5/2001 Moore
6,238,270 B1 5/2001 Robinson
6,238,273 B1 5/2001 Southwick
6,244,944 B1 6/2001 Elledge
6,250,994 B1 6/2001 Chopra et al.
6,261,163 B1 7/2001 Walker et al.
6,271,139 B1 8/2001 Alwan et al.
6,273,101 B1 8/2001 Gonzales et al.
6,273,800 B1 8/2001 Walker et al.
6,284,660 B1 9/2001 Doan
6,287,879 B1 9/2001 Gonzales et al.
6,290,572 B1 9/2001 Hofmann
6,296,557 B1 10/2001 Walker
6,301,006 B1 10/2001 Doan
6,306,008 B1 10/2001 Moore
6,306,014 B1 10/2001 Walker et al.
6,309,282 B1 10/2001 Wright et al.
6,312,558 B2 11/2001 Moore
6,319,420 B1 11/2001 Dow
6,323,046 B1 11/2001 Agarwal
6,325,702 B2 12/2001 Robinson
6,328,632 B1 12/2001 Chopra
6,331,135 B1 12/2001 Sabde et al.
6,331,139 B2 12/2001 Walker et al.
6,331,488 B1 12/2001 Doan et al.
6,350,180 B2 2/2002 Southwick
6,350,691 B1 2/2002 Lankford
6,352,466 B1 3/2002 Moore
6,352,470 B2 3/2002 Elledge
6,354,923 B1 * 3/2002 Lankford ..... 451/72

* cited by examiner

APPARATUS AND METHOD FOR ENHANCED PROCESSING OF MICROELECTRONIC WORKPIECES

TECHNICAL FIELD

The present disclosure relates to chemical-mechanical planarizing machines and methods to maintain processing pads and other planarizing media.

BACKGROUND OF THE INVENTION

Mechanical and chemical-mechanical planarizing processes (collectively "CMP") remove material from the surface of semiconductor wafers, field emission displays or other microelectronic workpieces in the production of microelectronic devices and other products. FIG. 1 schematically illustrates a CMP machine 10 with a platen 20, a carrier assembly 30, and a planarizing pad 40. The CMP machine 10 may also have an under-pad 25 attached to an upper surface 22 of the platen 20 and the lower surface of the planarizing pad 40. A drive assembly 26 rotates the platen 20 (indicated by arrow F), or it reciprocates the platen 20 back and forth (indicated by arrow G). Since the planarizing pad 40 is attached to the under-pad 25, the planarizing pad 40 moves with the platen 20 during planarization.

The carrier assembly 30 controls and protects the workpiece 12 during planarization. The carrier assembly 30 generally has a workpiece holder 32 to pick up, hold and release the workpiece 12 at appropriate stages of the planarizing process, or the workpiece 12 may be attached to a resilient pad 34 in the holder 32. The holder 32 may be a free-floating wafer carrier, or an actuator assembly 36 may be coupled to the holder 32 to impart axial and/or rotational motion to the workpiece 12 (indicated by arrows H and I, respectively).

The planarizing pad 40 and a planarizing solution 44 on the pad 40 collectively define a planarizing medium that mechanically and/or chemically-mechanically removes material from the surface of the workpiece 12. The planarizing pad 40 can be a soft pad or a hard pad. The planarizing pad 40 can also be a fixed-abrasive planarizing pad in which abrasive particles are fixedly bonded to a suspension material. In fixed-abrasive applications, the planarizing solution 44 is typically a non-abrasive "clean solution" without abrasive particles.

To planarize the workpiece 12 with the CMP machine 10, the carrier assembly 30 presses the workpiece 12 face-downward against the polishing medium. More specifically, the carrier assembly 30 generally presses the workpiece 12 against the planarizing solution 44 on a planarizing surface 42 of the planarizing pad 40, and the platen 20 and/or the carrier assembly 30 moves to rub the workpiece 12 against the planarizing surface 42. As the workpiece 12 rubs against the planarizing surface 42, material is removed from the face of the workpiece 12.

In the highly competitive semiconductor industry, it is desirable to maximize the throughput of CMP processing by producing a planar surface on a workpiece as quickly as possible. The throughput of CMP processing is a function, at least in part, of the polishing rate of the workpiece assembly and the ability to accurately stop CMP processing at a desired endpoint. The polishing rate is a function of several factors, many of which may change during planarization. For example, the condition of the planarizing surface on the planarizing medium can affect the polishing rate. Typically, the polishing rate for a fixed-abrasive pad decreases after planarizing 3 to 10 workpieces. Changes in the polishing rate can also occur at other, unexpected times during planarization thereby reducing the accuracy of stopping a planarizing cycle at a desired endpoint and reducing the consistency of planarity of the workpieces. Therefore, it is generally desirable for CMP processes to provide (a) a uniform polishing rate across the face of a workpiece to enhance the planarity of the finished workpiece surface, and (b) a reasonably consistent polishing rate during a planarizing cycle to enhance the accuracy of determining the endpoint of a planarizing cycle.

CMP processes should consistently and accurately produce a uniformly planar surface on the workpiece to enable precise fabrication of circuits and photo-patterns. During the construction of transistors, contacts, interconnects and other features, many workpieces develop large "step heights" that create highly topographic surfaces. Such highly topographical surfaces can impair the accuracy of subsequent photolithographic procedures and other processes that are necessary for forming sub-micron features. For example, it is difficult to accurately focus photo patterns to within tolerances approaching 0.1 micron on topographic surfaces because sub-micron photolithographic equipment generally has a very limited depth of field. Thus, CMP processes are often used to transform a topographical surface into a highly uniform, planar surface at various stages of manufacturing microelectronic devices on a workpiece.

One factor affecting the uniformity of the workpiece surface is the condition of the planarizing pad. The planarizing surface of the pad can deteriorate after polishing a number of workpieces because waste matter from the workpieces, planarizing solution and/or the pad accumulates on the planarizing surface. The planarizing surface can also deteriorate because rubbing the workpiece against the pad alters the planarizing surface of the pad in a manner that may produce inconsistent results in uniformity. The wear characteristics on the pad, for example, depend upon the density pattern of the workpiece because different types of workpieces produce different wear characteristics on the planarizing surface of the pad.

The effects of workpiece wear on fixed-abrasive pads are particularly problematic. A high density workpiece typically has more topographical variations on the active side of the workpiece than a low density workpiece; therefore, a high density workpiece more aggressively wears the pad than a low density workpiece. As such, the polishing rate for a run of high density workpieces may not drop significantly after planarizing several workpieces. On the other hand, low density workpieces do not aggressively wear the pad surface, and thus they often "passivate" the planarizing surface of the pad. This can quickly reduce the polishing rate of low density workpieces. Therefore, different planarizing pads are generally used to planarize different types of workpieces and/or products in fixed-abrasive CMP. Changing the pad for each type of workpiece, however, is time-consuming and reduces the throughput of using fixed-abrasive pads.

One conventional technique to decrease the variability of CMP processing is "conditioning" the pad to restore the surface of the pad to a consistent state. Non-abrasive planarizing pads are conventionally conditioned with devices that rub an abrasive element on the planarizing surface. For example, one method for conditioning non-abrasive pads is to abrade the planarizing surface with a diamond end-effector. Another method to condition fixed-abrasive or non-abrasive pads involves agitating the pad-slurry-wafer interface using ultrasound to prevent the accumulation of particulate matter on the pad.

U.S. Pat. No. 6,083,085 issued to Lankford discloses a conditioning device for conditioning planarizing media. The conditioning device has a support assembly with a support member and a conditioning head attached to the support member. The support member may be a pivoting arm that carries the conditioning head over the planarizing medium. The conditioning head may have a non-contact conditioning element that transmits a form of non-contact energy to waste matter on the planarizing medium. For example, the non-contact conditioning element can be a mechanical-wave transmitter that transmits mechanical waves that act against waste matter on the planarizing pad to break the bonds between the planarizing medium and the waste matter. U.S. Pat. No. 5,895,550 issued to Andreas discloses a method and apparatus for chemical mechanical polishing that includes an acoustic energy source positioned to transmit acoustic energy into a polishing slurry to break up agglomerated particles in the slurry before the polishing slurry contacts the wafer surface. U.S. Pat. No. 5,245,790 issued to Jerbic discloses a chemical-mechanical polishing apparatus that includes an ultrasonic transducer mounted to the underside of a platen that introduces mechanical vibratory energy against the pad or into the slurry during polishing. Jerbic, more specifically, discloses that the frequency of the transducer is selected to be approximately two or more orders of magnitude higher than the rotational frequency of the platen.

Although the devices and methods disclosed in the above-referenced patents are useful for overcoming certain problems regarding the variability of the planarizing pads, these patents do not address other problems associated with planarizing different types of workpieces. For example, these patents do not address the problems associated with changing the pads for planarizing different types of workpieces on a single CMP machine. These patents also do not address the problems associated with fluctuations in the polishing rate during a planarizing cycle of a workpiece. Thus, it would be desirable to develop a method and apparatus for (a) processing different types of workpieces on the same pad, and (b) preventing fluctuations in the polishing rate during a planarizing cycle.

SUMMARY OF THE INVENTION

The present invention is directed toward chemical-mechanical planarizing machines and methods to maintain processing pads and other planarizing media used in planarizing microelectronic workpieces. In one embodiment of the invention, a method for planarizing a microelectronic workpiece includes pre-conditioning a planarizing pad for processing different types of workpieces having different feature densities and topographical patterns. For example, one embodiment of a planarizing machine can include a planarizing medium carried by a support member, a workpiece carrier configured to hold a microelectronic workpiece, and a surfacing device attached to one of the carrier or the support member. The surfacing device is positioned to transmit a non-abrasive energy, such as ultrasonic waves, a laser, and/or a water-jet, against the planarizing medium. The planarizing machine can also include a controller that is operatively coupled to the surfacing device for activating the surfacing device at appropriate moments either before or during a planarizing cycle of a microelectronic workpiece.

The controller can be a computer having a database containing instructions for causing the surfacing device to transmit the non-abrasive energy against the planarizing pad. In one embodiment, the instructions in the database activate the surfacing device when the controller receives input that a low density workpiece is to be planarized. The instructions in the database can also cause the surfacing device to transmit energy to the pad throughout at least a portion of a planarizing cycle for the low density workpiece.

In another aspect of the invention, a method for planarizing a microelectronic workpiece includes monitoring the planarity of the workpiece and causing the surfacing device to transmit energy to the planarizing pad upon an indication that the workpiece surface is at least approximately planar. For example, one embodiment of the planarizing machine can include a planarity detection system that (a) monitors a parameter indicative of planarity of the workpiece, and (b) signals the controller to activate the surfacing device at an indication of planarity. One embodiment of a planarity detection system is a device that monitors the drag force between the workpiece and the polishing pad, and estimates the onset of planarity by a step-like change in the drag force. For example, the drag force can be monitored by sensing the draw of electrical current to operate a motor that moves the table and/or the workpiece holder, and the controller can activate the surfacing device when the current draw changes in a manner that commonly occurs when the workpiece is at least approximately planar.

DETAILED DESCRIPTION

The following disclosure describes planarizing machines and methods for mechanical and/or chemical-mechanical planarization processing of microelectronic workpieces. Although a significant portion of the present disclosure focuses on these forms of processing workpieces, other machines and methods described below can also be used in electrochemical mechanical processes. The microelectronic workpieces can be semiconductor wafers, field emission displays, read/write media, and many other types of workpieces that have microelectronic devices with miniature components. Many specific details of certain embodiments of the invention are set forth in the following description and in FIGS. 2–7 to provide a thorough understanding of such embodiments. It will be appreciated that like reference numbers refer to like components in FIGS. 2–7. A person skilled in the art will thus understand that the invention may have additional embodiments, or that the invention may be practiced without several of the details described below.

Figure 1:
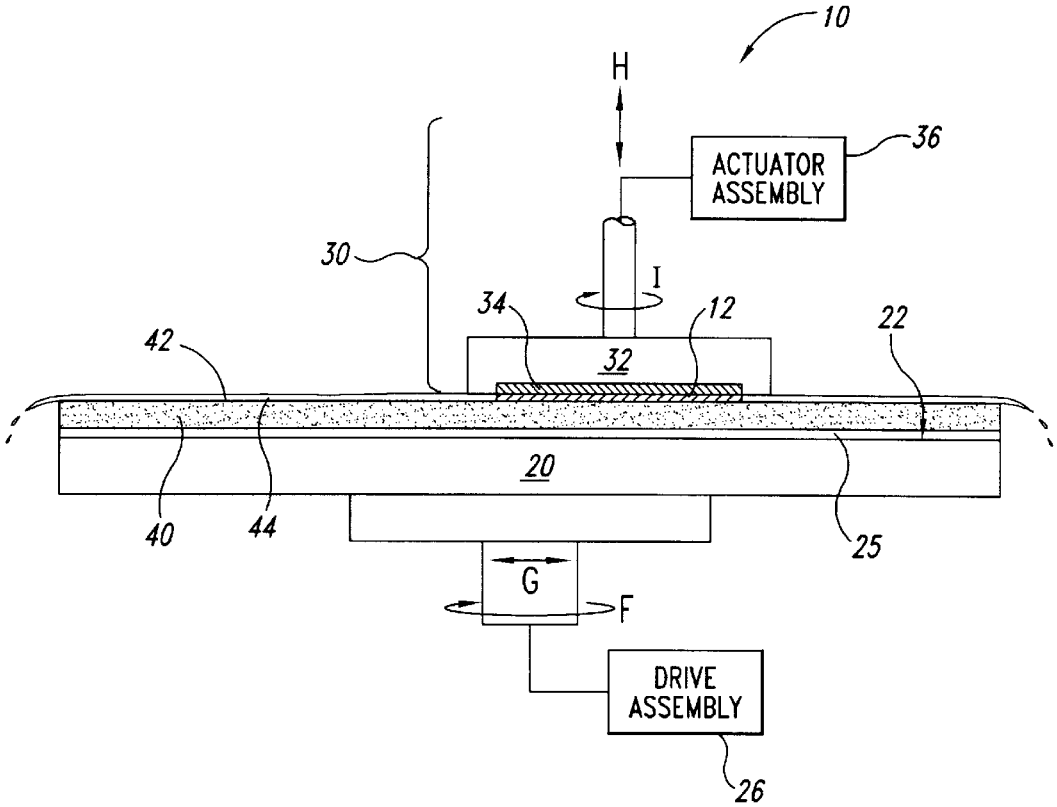
Fig. 1 (Prior Art)
FIG. 1 is a side elevation view of a planarizing machine in accordance with the prior art with selected components shown schematically.
Figure 2:
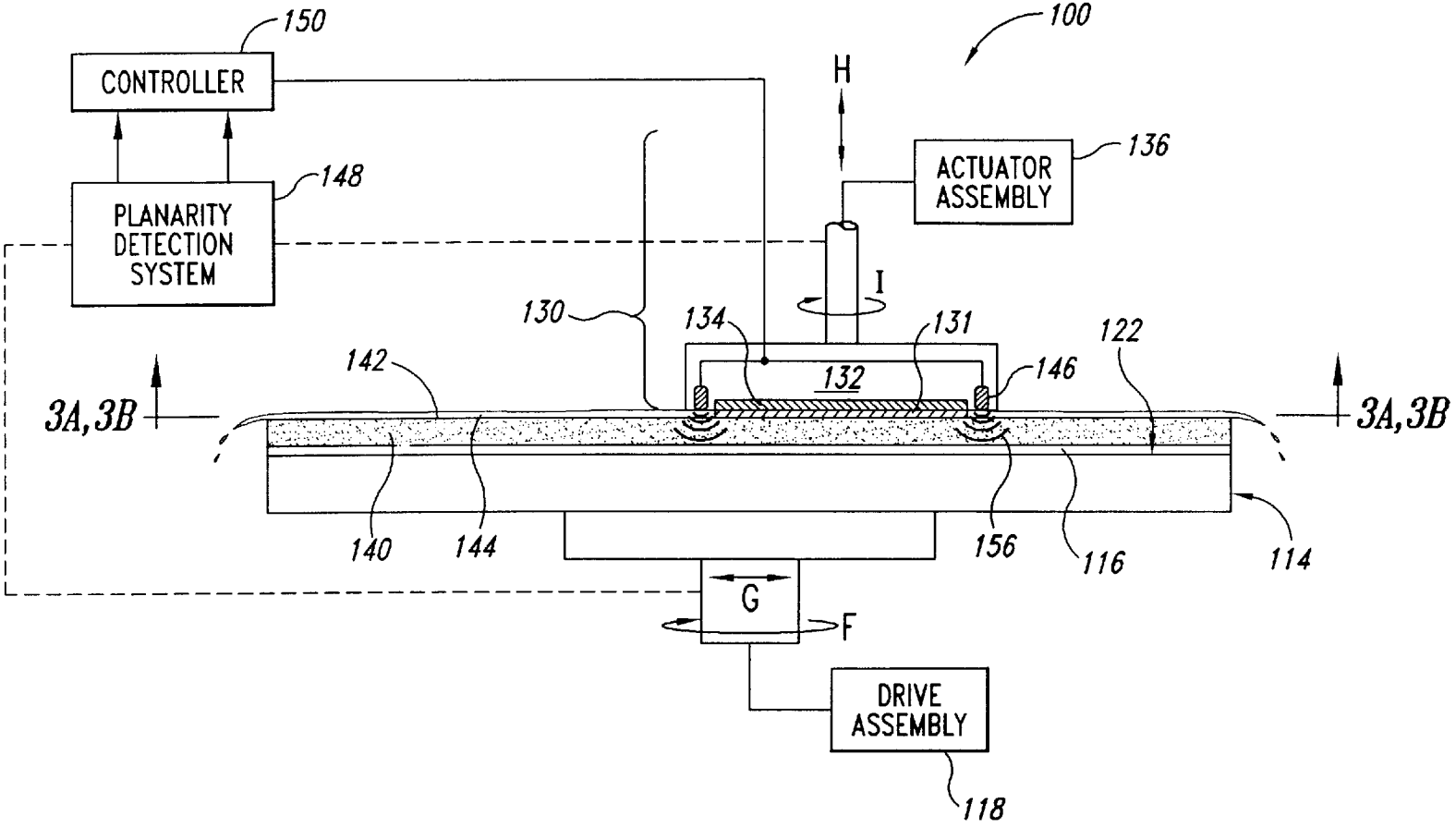
FIG. 2 is a side elevation view of a planarizing machine including a surfacing device in accordance with an embodiment of the invention. Selected components are shown in cross section or schematically.

FIG. 2 is a cross-sectional view of a planarizing machine 100 in accordance with one embodiment of the invention. The planarizing machine 100 has a table 114 with a top panel 116 attached to the upper surface 122 of the table 114. The top panel 116 is generally a rigid plate to provide a flat, solid surface for supporting a processing pad. In this embodiment, the table 114 is a rotating platen that is driven by a drive assembly 118. The planarizing machine 100 also includes a workpiece carrier assembly 130 that controls and protects a microelectronic workpiece 131 during planarization or electrochemical-mechanical processes. The carrier assembly 130 can include a workpiece holder 132 to pick up, hold and release the workpiece 131 at appropriate stages of a planarizing cycle and/or a conditioning cycle. The carrier assembly 130 also generally has a backing member 134 contacting the backside of the workpiece 131 and an actuator assembly 136 coupled to the workpiece holder 132. The actuator assembly 136 can move the workpiece holder 132 vertically (arrow H), rotate the workpiece holder 132 (arrow 1), and/or translate the workpiece holder 132 laterally. In a typical operation, the actuator assembly 136 moves the workpiece holder 132 to press the workpiece 131 against a processing pad 140.

The processing pad 140 shown in FIG. 2 has a planarizing medium 142 and a contact surface 144 for selectively removing material from the surface of the workpiece 131. The planarizing pad 140 can also be a fixed-abrasive planarizing pad in which abrasive particles are fixedly bonded to a suspension material. In fixed-abrasive applications, the planarizing medium 142 is typically a non-abrasive "clean solution" without abrasive particles.

In one embodiment shown in FIG. 2, the planarizing machine 100 further includes at least one surfacing device 146 carried by the workpiece holder 132. The surfacing device 146 may be a transmitter that directs a form of non-abrasive energy against the planarizing medium 142. The surfacing device 146, for example, can be an ultrasonic transducer that transmits energy waves 156 against the processing pad 140. The transducer may be a piezoelectric material, such as metallized quartz, or other commercially available ultrasonic transducers can be used for the surfacing device 146. The surfacing device can be a low-intensity or high-intensity wave-generator that typically operates in the ultrasonic range (i.e., above 20 kHz). It will be appreciated that other types of surfacing devices, such as lasers and/or fluid-jets, may also be used either in addition to or in lieu of ultrasonic devices. For example, a laser can direct a light beam or a water-jet can direct a high-velocity stream or spray of fluid against the pad. As explained in more detail below, the surfacing devices are expected to be particularly useful in combination with fixed-abrasive pads because the surfacing devices expose abrasive particles embedded in fixed-abrasive pads for providing a more consistent planarizing surface.

Figure 3A:
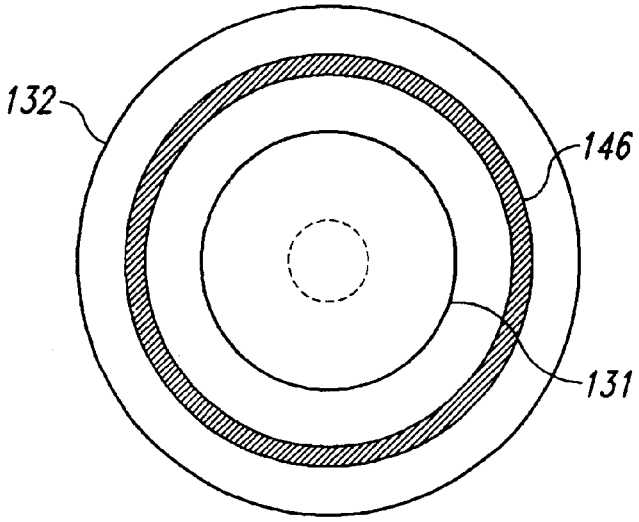
FIGS. 3A and 3B are bottom plan views of the apparatus shown in FIG. 2.
Figure 3B:
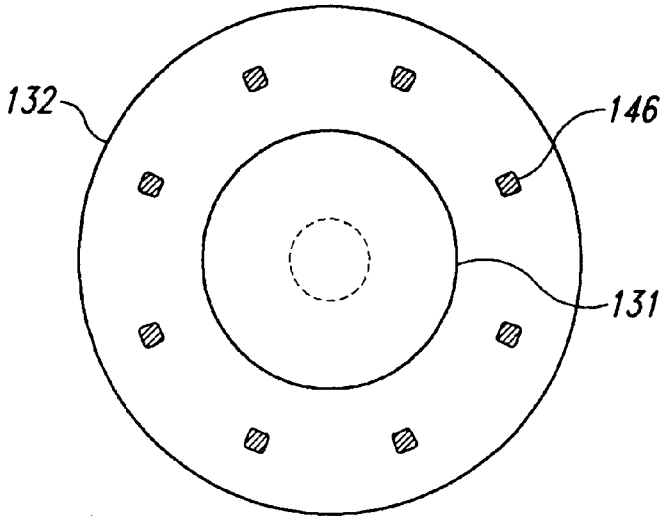

FIGS. 3A and 3B are bottom plan views of various configurations for surfacing devices 146 used in selected embodiments of the planarizing machine shown in FIG. 2. In one embodiment shown in FIG. 3A, the surfacing device 146 is an annular transducer that is attached to the underside of the workpiece holder 132. The annular transducer can be a full ring as shown in FIG. 3A or an annular segment of a ring. In another embodiment shown in FIG. 3B, the surfacing device 146 comprises a plurality of point transducers attached to the underside of the workpiece holder 132.

Figure 4:
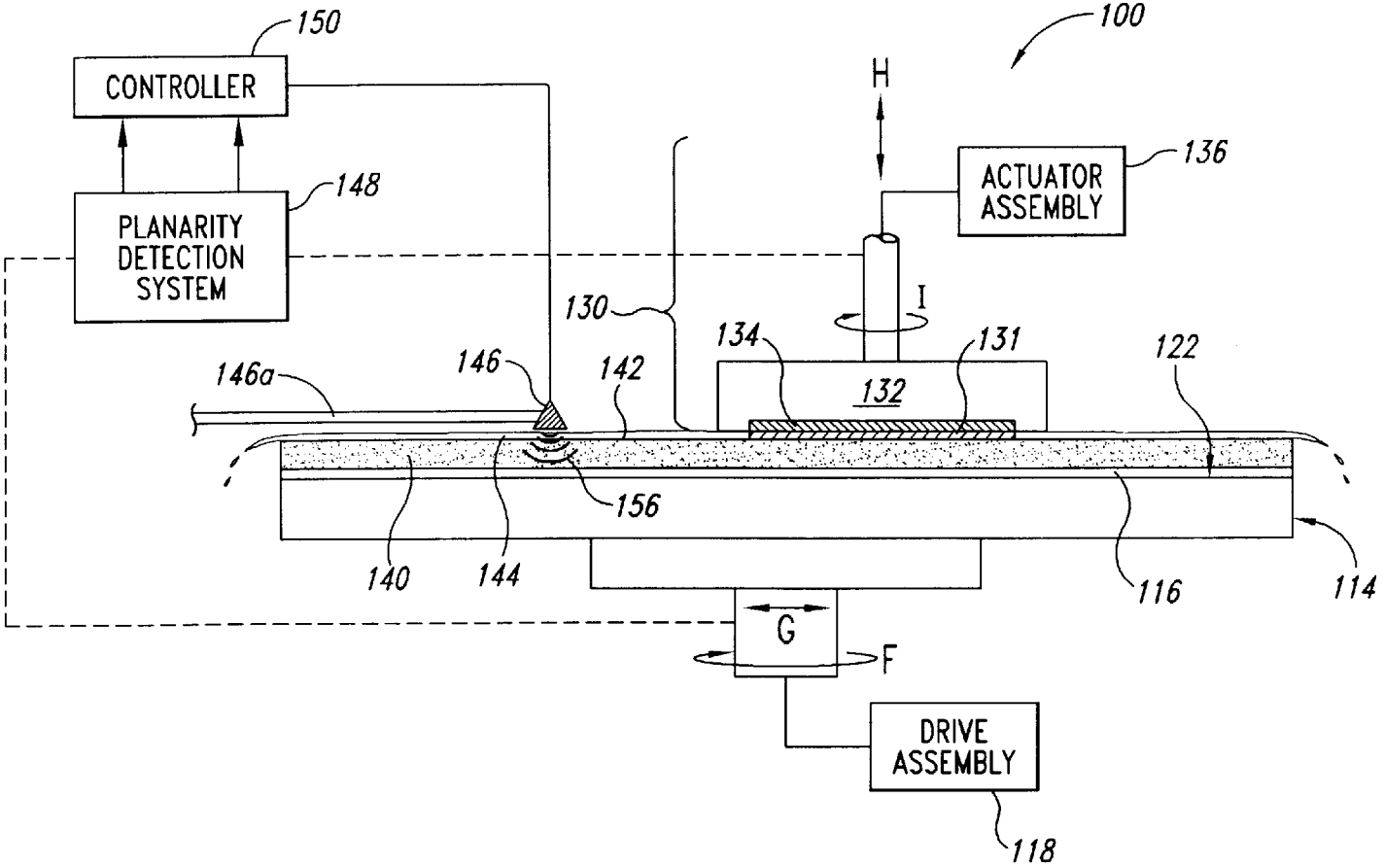
FIG. 4 is a side elevation view of a planarizing machine including a surfacing device in accordance with another embodiment of the invention. Selected components are shown in cross section or schematically.

FIG. 4 is a cross sectional view of another embodiment of a planarizing machine similar to the planarizing machine 100 shown in FIG. 2. In FIG. 4, the surfacing device 146 is carried by an arm 146*a* extending over the pad 140. The arm 146*a* can position the transducer 146 over the processing pad 140 to transmit energy waves 156 or other forms of energy to the pad. As such, the embodiments of the planarizing machine 100 have surfacing devices 146 that are juxtaposed to the pad 140

Referring still to FIGS. 2 and 4, certain embodiments of the planarizing machine 100 can also include a planarity detection system 148 and a computer 150 operatively coupled to the surfacing device 146 and the planarity detection system 148. The planarity detection system 148 is operatively coupled to the actuator assembly 136, the drive assembly 118, and/or the table 114. During a planarizing cycle, the planarity detection system 148 indicates when the surface of the microelectronic workpiece 131 has become at least approximately planar. The surface planarity can be detected by sensing a change in drag force between the workpiece 131 and the processing pad 140. In one embodiment shown in FIGS. 2 and 4, the change in drag force is detected by measuring the current draw of one or both of the motors used to move the workpiece holder 132 or the table 114. When the workpiece 131 becomes planar, the planarity detection system 148 generates a signal that can be used by the computer 150 to activate the surfacing device 146. Suitable devices for detecting the onset of planarity are disclosed in U.S. Pat. Nos. 5,036,015 and 5,069,002, which are herein incorporated by reference.

In-situ endpoint detection can also be accomplished by a reflectance measurement device coupled to a window (not shown) embedded within the table 114 that provides a reflectance signal corresponding to a prescribed condition of the processing pad. Suitable reflectance-based detection devices are disclosed in U.S. Pat. No. 5,433,651 and U.S. application Ser. No. 09/534,248, which are herein incorporated by reference. U.S. Pat. No. 6,234,878, which is also incorporated herein by reference, discloses another method for endpoint detection that includes a force detector (not shown) attached to a table that supports a processing pad. The force detector measures the lateral forces between the primary support member and a secondary support member in response to drag forces between a workpiece and a processing pad. In operation, the onset of planarity is detected when the measured lateral force is equal to a predetermined planarity force. It will be appreciated that any of these endpoint detection systems are suitable for use as the planarity detection system 148 in the planarizing machine 100.

The planarizing machine 100 can operate to provide a desired polishing rate throughout at least a portion of a planarizing cycle. In one embodiment, the microelectronic workpiece 131 presses against the fixed-abrasive planarizing pad 140, and then the microelectronic workpiece 131 and/or the planarizing pad 140 moves to rub the microelectronic workpiece 131 against the abrasive contact surface 144 of the pad 140. The planarity detection system 148 monitors the status of the surface topography of the microelectronic workpiece 131. When the surface of the microelectronic workpiece 131 becomes at least approximately planar, the computer 150 receives a signal from the planarity detection system 148 and activates the surfacing device 146 to transmit a non-abrasive energy against the planarizing pad 140 during the planarizing cycle.

Figure 5A:
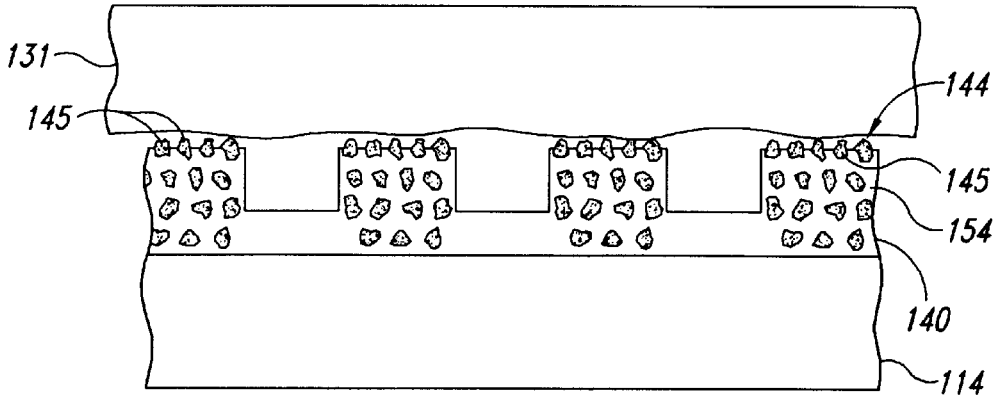
FIGS. 5A–C are cross sectional views of a planarizing pad illustrating stages of a method for CMP processing in accordance with an embodiment of the invention.
Figure 5B:
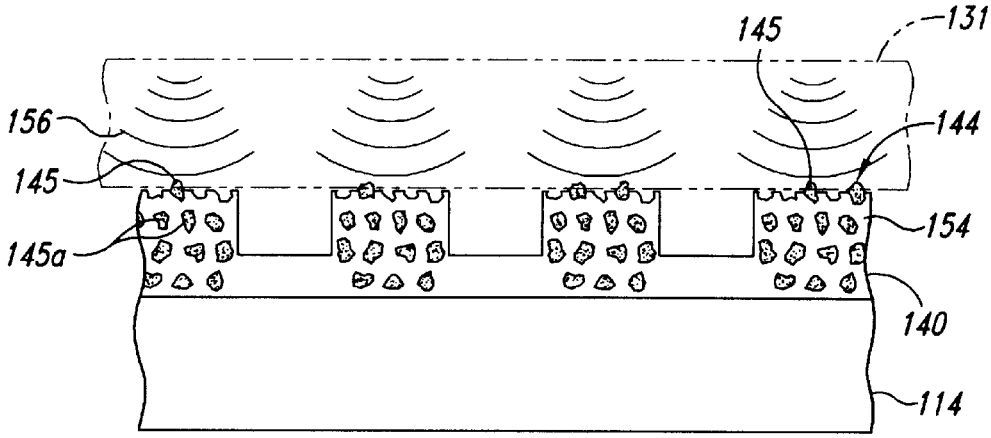
Figure 5C:
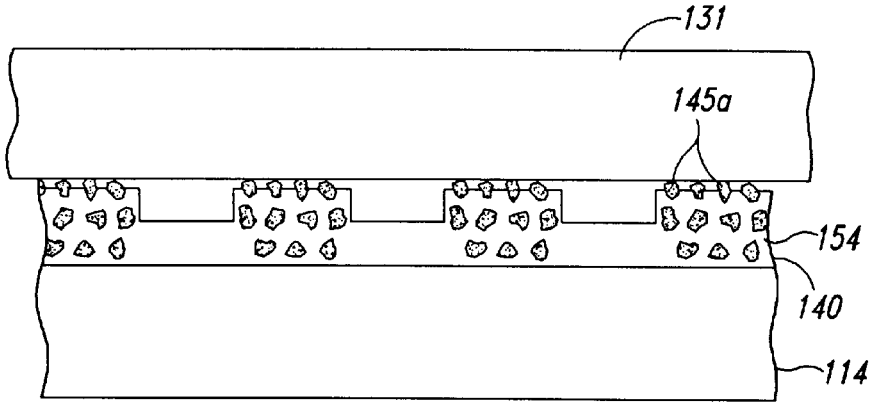

FIGS. 5A–C are cross sectional views illustrating an example of the mechanism that the present inventor believes is involved in providing a more consistent polishing rate during at least a portion of the planarizing cycle using the planarizing machine 100. FIG. 5A shows a fixed-abrasive processing pad 140 having an abrasive contact surface 144 with a large number of exposed abrasive particles 145. The abrasive particles 145 can be distributed in a resin or polymeric binder 154, and the contact surface 144 can be a patterned surface having a number of grooves or raised features. Referring to FIG. 5A, a microelectronic workpiece 131 rubs against the exposed abrasive particles 145 on the contact surface 144 of the pad 140 during an initial stage of a planarizing cycle. As the workpiece 131 becomes planar, it wears away a significant number of the exposed abrasive particles 145 at the contact surface 144, which leaves a layer of the underlying polymer or resin 154. FIG. 5B, for example, illustrates the contact surface 144 of the fixed-abrasive pad 140 when the workpiece 131 is planar or at least approximately planar. At this point in the planarizing cycle, the polishing rate typically drops because the contact surface 144 is not as abrasive as it was when it had more of the exposed abrasive particles 145. As explained above, the planarity detection system 148 shown in FIGS. 2 and 4 monitors the onset of planarity of the microelectronic workpiece 131 and signals the computer 150 to activate the surfacing device 146 to transmit a non-abrasive energy 56 against the planarizing pad 140.

FIG. 5B also demonstrates impinging non-abrasive energy waves 156 against the contact surface 144 of the pad 140. The energy waves 156 are expected to remove the resin binder at the contact surface 144. As a result, the energy waves 156 expose additional abrasive particles 145*a* that were originally covered by the abrasive particles 145 during the initial stage of the planarizing cycle and disperse some of the particles 145 to the planarizing solution.

FIG. 5C illustrates the exposed abrasive particles 145*a* at the contact surface 144 of the pad 140 after transmitting the ultrasonic energy against the pad 140. The newly exposed abrasive particles 145*a* contact the face of the workpiece 131 to increase the polishing rate of the workpiece 131 as it becomes planar. As such, in applications that monitor the planarity of the workpiece 131, the aggressiveness of the mechanical planarizing component can be selectively increased based upon the planarity of the workpiece 131 (e.g., at the onset of planarity). Such an increase in only the mechanical component can advantageously be achieved without having to change the flow of planarizing solution going to the pad.

The process shown in FIGS. 5A–5C can be carried out with an ultrasonic transducer to generate the energy waves 156. In other embodiments, a laser can impinge a high-energy light beam against the pad to consume the resin 154, or a water-jet can spray a high-velocity fluid to remove a top stratum of the pad. For the purposes of the present disclosure, each of these types of surfacing devices impinges a non-abrasive energy against the contact surface 144 of the pad 140. The process shown in FIGS. 5A–5C is expected to provide a more consistent distribution of abrasive particles 145 at the contact surface 144. This should provide a more consistent polishing rate throughout the planarizing cycle and enhance the throughput of CMP processing.

Figure 6:
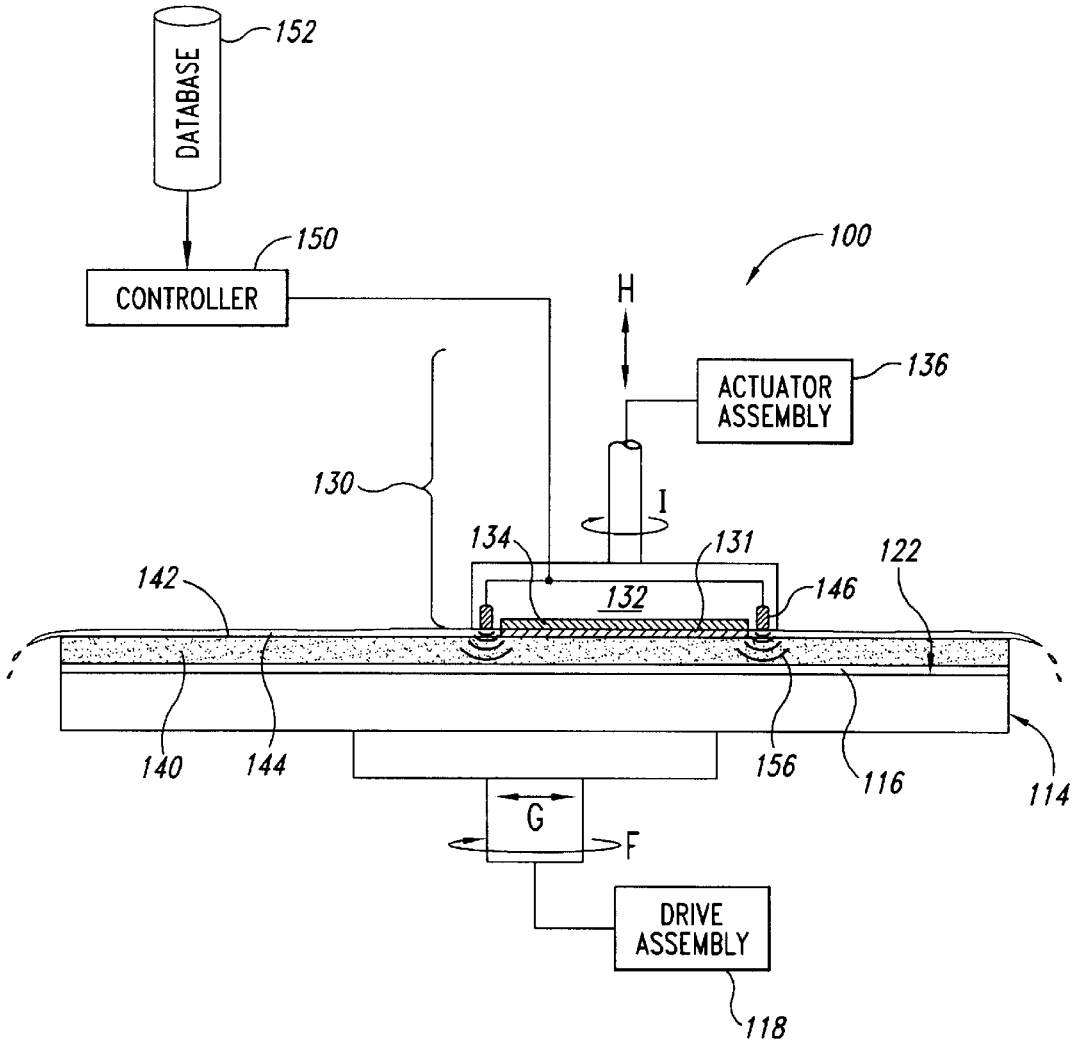
FIG. 6 is a side elevation view of a planarizing machine including a surfacing device in accordance with another embodiment of the invention. Selected components are shown in cross section or schematically.

FIG. 6 illustrates another embodiment of the planarizing machine 100 that includes the table 114, the workpiece carrier assembly 130, the processing pad 140, the surfacing device 146, and the computer 150, which can be the same or substantially similar to the components described above with reference to FIGS. 2 and 4. The planarizing machine 100 also includes a database 152 containing sets of predetermined data having density patterns of different types of microelectronic workpieces and corresponding amounts of surfacing that needs to be performed on the pad surface to bring the pad to a state suitable for processing each type of workpiece. The database 152 can be contained on a computer-operable medium stored in the computer 150.

The predetermined data sets in the database 152 include instructions for controlling the surfacing device 146 to transmit a non-abrasive energy, such as ultrasonic energy waves, against the processing pad 140. The instructions for operating the surfacing device 146 may be based on the density patterns of the microelectronic workpieces and the corresponding condition that the pad should be in to planarize workpieces with different feature densities. For example, because high density workpieces typically have more topographical variations than low density workpieces, the high density workpieces more aggressively wear the processing pad. High-density workpieces can be, in effect, "self-conditioning." Therefore, to planarize high density workpieces, the instructions in the database 152 cause the surfacing device 146 to transmit less non-abrasive energy against the pad 140. This can be accomplished by using lower intensity energy waves or by limiting the duration that the surfacing device 146 is activated. A low density workpiece generally has less topographical formations; therefore, the surfacing device 146 transmits more non-abrasive energy against the processing pad 140 in the form of higher intensity energy waves or longer periods of activating the surfacing device 146.

In one embodiment of operating the planarizing machine 100, the pad 140 is "pre-conditioned" before planarizing a low density workpiece instead of changing the processing pad 140. For example, a run of high density microelectronic workpieces 131 can be planarized by rubbing the microelectronic workpiece 131 against the abrasive contact surface 144 of the pad 140. When processing a high density workpiece, the predetermined instructions stored in the database 152 can direct the computer 150 to activate the surfacing device 146 so that it transmits a non-abrasive energy against the processing pad 140 for only a portion of the planarizing cycle. In an alternate embodiment, the instructions in the database 152 may not cause the surfacing device 146 to be activated at all either during or between planarizing cycles of high-density workpieces. After planarizing a run of high density microelectronic workpieces, the planarizing pad 140 can be used planarize a run of low density workpieces because the predetermined instructions stored in the database 152 can direct the computer 150 to activate the surfacing device 146 to "pre-condition" the pad 140. The non-abrasive energy is expected to expose additional abrasive particles on the contact surface 144 of the pad 140 for processing a low density workpiece 131. The instructions can also direct the computer 150 to also transmit the non-abrasive energy against the processing pad 140 while processing the low density workpiece 131. Several embodiments of processes for operating the CMP machine 100 shown in FIG. 6 are thus expected to allow the same processing pad to be used for processing different types of microelectronic workpieces. As a result, several embodiments of the CMP machine 100 should reduce the time and cost of changing pads for each type of workpiece, which will enhance the throughput of CMP processing using fixed-abrasive pads.

Figure 7:
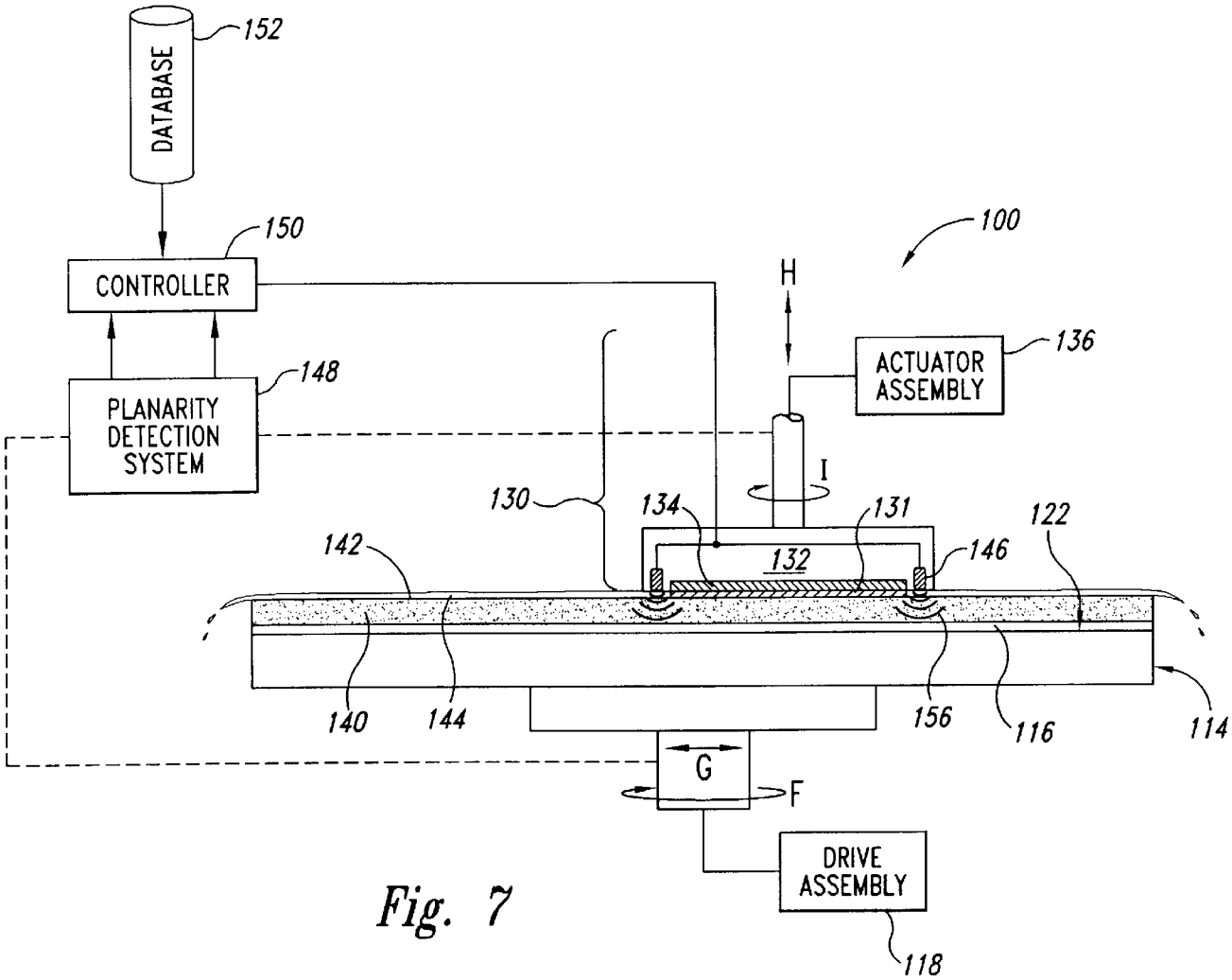
FIG. 7 is a side elevation view of a planarizing machine with a surfacing device in accordance with an embodiment of the invention. Selected components are shown in cross-section or schematically.

FIG. 7 illustrates another embodiment of the planarizing machine 100 that includes the table 114, the workpiece carrier assembly 130, the processing pad 140, a surfacing device 146, a planarity detection system 148, and a computer 150. These components can be the same or substantially similar to those described above with reference to FIGS. 2 and 4. Thus, like reference numbers refer to like components in FIGS. 1–4 and 7.

Several embodiments of the planarizing machine 100 shown in FIG. 7 can provide a desired polishing rate throughout at least a portion of a planarizing cycle and "pre-condition" a pad 140 before planarizing a low density workpiece instead of changing the processing pad 140. In one embodiment, the planarity detection system 148 monitors the status of the topography of the surface of the microelectronic workpiece 131. When the surface of the microelectronic workpiece 131 becomes at least approximately planar, the computer 150 receives a signal from the planarity detection system 148 and activates the surfacing device 146 to transmit a non-abrasive energy against the planarizing pad 140 during the planarizing cycle. Additionally, to transition from planarizing a run of high density workpieces to a run of low density workpieces, the predetermined instructions stored in the database 152 direct the computer 150 to activate the surfacing device 146 to transmit a non-abrasive energy against the processing pad 140 in a manner that "pre-conditions" the pad 140 for processing low density workpieces. Thus, several embodiments of the planarizing machine 100 shown in FIG. 7 combine the features of the embodiments of the planarizing machines shown in FIGS. 1–6.

From the foregoing, it will be appreciated that specific methods and embodiments of the invention have been described herein for purposes of illustration, but that various modifications may be made without deviating from the spirit and scope of the invention. Accordingly, the invention is not limited except as by the appended claims.

I claim:

1. An apparatus for planarizing a microelectronic workpiece, comprising:

a planarizing medium carried by a support member;

a workpiece carrier configured to hold a microelectronic workpiece, wherein at least one of the carrier and the planarizing medium is movable relative to the other to rub the workpiece against the planarizing medium;

a surfacing device juxtaposed to the planarizing medium, wherein the surfacing device projects a non-abrasive energy against the planarizing medium;

a planarity detection system that monitors a parameter indicative of the planarity of the workpiece; and a controller operatively coupled to the surfacing device and the detection system, the controller having a computer operable medium that contains instructions that cause the surfacing device to impart a non-abrasive energy to the planarizing medium based upon a signal from the detection system indicating that the workpiece is at a predetermined stage of processing.

2. The apparatus of claim 1 wherein the surfacing device comprises a laser that emits a laser beam defining the non-abrasive energy.

3. The apparatus of claim 1 wherein the surfacing device comprises a fluid-jet that directs a high velocity stream defining the non-abrasive energy.

4. The apparatus of claim 1 wherein the surfacing device comprises an ultrasonic transducer that generates ultrasonic waves defining the non-abrasive energy.

5. The apparatus of claim 1 wherein the surfacing device is carried by the workpiece carrier.

6. The apparatus of claim 1 wherein the surfacing device is attached to an arm extending over the planarizing medium.

7. The apparatus of claim 1 wherein the surfacing device comprises a piezoelectric transducer.

8. The apparatus of claim 1 wherein the surfacing device comprises an annular ultrasonic transducer carried by the workpiece carrier.

9. The apparatus of claim 1 wherein the surfacing device comprises a plurality of ultrasonic point transducers carried by the workpiece carrier.

10. The apparatus of claim 1 wherein the planarity detection system is configured to monitor changes in the electrical current motor that drives the carrier or the support member; and signals the controller to activate the surfacing device.

11. The apparatus of claim 1 further comprising a database having instructions that cause the surfacing device to impart the non-abrasive energy to the planarizing medium based upon a topography of the workpiece.

12. An apparatus for planarizing a microelectronic workpiece, comprising:

a table;

a planarizing medium carried by the table;

a workpiece carrier configured to hold a microelectronic workpiece, the carrier facing the planarizing medium, and at least one of the carrier and the planarizing medium being movable relative to the other to press the microelectronic workpiece against the planarizing medium;

a non-contact energy device attached to a peripheral area of the carrier, wherein the non-contact energy device faces the planarizing medium when the workpiece is in contact with the planarizing medium;

a planarity detection system that monitors a parameter indicative of the planarity of the workpiece; and a controller operatively coupled to the non-contact energy device and the detection system, the controller having a computer operable medium that contains instructions that cause the non-contact energy device to impart non-contact energy to the planarizing medium based upon a signal from the detection system indicating that the workpiece is at least approximately planar.

13. The apparatus of claim 12 wherein the non-contact energy device comprises a laser that emits a laser beam defining the non-contact energy.

14. The apparatus of claim 12 wherein the non-contact energy device comprises an ultrasonic transducer that generates ultrasonic waves defining the non-contact energy.

15. The apparatus of claim 12 wherein the non-contact energy device comprises a piezoelectric transducer.

16. The apparatus of claim 12 wherein the non-contact energy device comprises an annular ultrasonic transducer carried by the workpiece carrier.

17. The apparatus of claim 12 wherein the non-contact energy device comprises a plurality of ultrasonic point transducers carried by the workpiece carrier.

18. The apparatus of claim 12 further comprising a database having instructions that cause the non-contact energy device to impart the non-contact energy to the planarizing medium based upon a topography of the workpiece.

19. The apparatus of claim 12 wherein the planarity detection system is configured to monitor a change in drag force between the workpiece and the planarizing medium and signal the controller to activate the non-contact energy device when the drag force indicates the workpiece is at least approximately planar.

20. The apparatus of claim 12 further comprising a database having instructions that cause the non-contact energy device to impart the non-contact energy after planarizing a high density workpiece and before planarizing a low density workpiece.

21. An apparatus for planarizing a microelectronic workpiece, comprising:

a planarizing medium carried by a support member;

a workpiece carrier configured to hold a microelectronic workpiece, wherein at least one of the carrier and the planarizing medium is movable relative to the other to rub the workpiece against the planarizing medium;

a non-contact energy device attached to one of the carrier or the support member that transmits a non-contact energy against the planarizing medium; and a controller operatively coupled to the non-contact energy device, wherein the controller includes a computer operable medium containing a database having instructions that cause the non-contact energy device to impart a non-contact energy to the planarizing medium based upon a topography of the workpiece.

22. The apparatus of claim 21 further comprising:

a planarity detection system that monitors a parameter indicative of the planarity of the workpiece and signals the controller to activate the non-contact energy device when the parameter indicates the workpiece is at least approximately planar; and a computer-operable medium containing instructions that cause the non-contact energy device to impart non-contact energy to the planarizing medium based upon a signal from the planarity detection system indicating that the workpiece is at least approximately planar.

23. The apparatus of claim 21 further comprising:

a planarity detection system that monitors a change in drag force between the workpiece and the planarizing medium and signals the controller to activate the non-contact energy device when the drag force indicates the workpiece is at least approximately planar; and a computer-operable medium containing instructions that cause the non-contact energy device to impart non-contact energy to the planarizing medium based upon a signal from the planarity detection system indicating that the workpiece is at least approximately planar.

24. The apparatus of claim 21 further comprising a database having instructions that cause the non-contact energy device to impart the non-contact energy after planarizing a high density workpiece and before planarizing a low density workpiece.

25. An apparatus for planarizing a microelectronic workpiece, comprising:

a planarizing medium carried by a support member;

a workpiece carrier configured to hold a microelectronic workpiece, wherein at least one of the carrier and the planarizing medium is movable relative to the other to rub the workpiece against the planarizing medium;

a surfacing device attached to one of the carrier or the support member that transmits a non-abrasive energy against the planarizing medium;

a planarity detection system that monitors a parameter indicative of the planarity of the workpiece; and a controller operatively coupled to the surfacing device and the detection system, the controller having a computer operable medium that activates the surfacing device to impart a non-abrasive energy to the planarizing medium based upon a signal from the detection system indicating that the workpiece is planar, and the computer operable medium further including a database having instructions for activating the surfacing device to impart a non-abrasive energy to the planarizing medium based upon a topography of the workpiece.

26. A method of planarizing a microelectronic workpiece, comprising:

pressing a surface of the microelectronic workpiece against a planarizing surface of a planarizing medium;

moving the microelectronic workpiece and/or the planarizing medium relative to one another to rub the workpiece against the planarizing surface;

inputting a status of a topography of the workpiece; and transmitting a non-abrasive energy against the planarizing medium while rubbing the workpiece against the planarizing surface, wherein transmitting the non-abrasive energy is initiated based upon the input of the status of the topography of the workpiece.

27. The method of claim 26 wherein transmitting a non-abrasive energy comprises directing ultrasonic energy toward the planarizing medium while rubbing the workpiece against the planarizing surface.

28. The method of claim 26 wherein transmitting a non-abrasive energy comprises directing a laser beam toward the planarizing medium while rubbing the workpiece against the planarizing surface.

29. The method of claim 26 wherein transmitting a non-abrasive energy comprises directing a high velocity stream against the planarizing medium while rubbing the workpiece against the planarizing surface.

30. The method of claim 26 wherein inputting the status of the topography comprises inputting a predetermined set of data corresponding to density patterns of the microelectronic workpiece.

31. The method of claim 26 wherein:

inputting the status of the topography comprises inputting an indication for planarizing a low density workpiece after planarizing a high density workpiece; and transmitting the non-abrasive energy against the planarizing medium further comprises transmitting the non-abrasive energy against the same planarizing medium used for planarizing the high density workpiece before planarizing the low density workpiece.

32. The method of claim 26 wherein:

inputting the status of the topography comprises monitoring a parameter indicative of planarity of the workpiece;

generating a signal indicating that the workpiece is at least approximately planar; and transmitting a non-abrasive energy against the planarizing medium further comprises activating a surfacing device based upon the signal indicating that the workpiece is at least or approximately planar.

33. The method of claim 26 wherein:

inputting the status of the topography comprises monitoring a change in drag force between the workpiece and the planarizing medium;

generating a signal when the drag force indicates the workpiece is at least approximately planar; and transmitting a non-abrasive energy against the planarizing medium further comprises activating a surfacing device based upon the signal indicating that the workpiece is at least approximately planar.

34. A method of planarizing a microelectronic workpiece, comprising:

pressing a microelectronic workpiece against a planarizing surface of a planarizing medium;

moving the microelectronic workpiece and/or the planarizing medium relative to one another to rub the workpiece against the planarizing surface;

receiving input from a planarity detection system regarding the status of the topography of the workpiece; and transmitting a non-contact energy against the planarizing medium while rubbing the workpiece against the planarizing surface.

35. The method of claim 34 wherein receiving input from a planarity detection system further comprises monitoring a parameter indicative of the planarity of the workpiece.

36. The method of claim 34 wherein receiving input from a planarity detection system further comprises monitoring a change in drag force between the workpiece and the planarizing medium.

37. The method of claim 34 wherein transmitting a non-contact energy comprises transmitting ultrasonic energy toward the planarizing medium while rubbing the workpiece against the planarizing surface.

38. The method of claim 34 wherein transmitting a non-contact energy comprises transmitting a laser beam toward the planarizing medium while rubbing the workpiece against the planarizing surface.

39. A method of planarizing a microelectronic workpiece, comprising:

pressing a surface of a microelectronic workpiece against a planarizing surface of a planarizing medium;

moving the microelectronic workpiece and/or the planarizing medium relative to one another to rub the workpiece against the planarizing surface; and receiving instructions to activate a surfacing device to transmit a non-abrasive energy against the planarizing medium while rubbing the workpiece against the planarizing surface based upon a topography of the workpiece; and transmitting the non-abrasive energy from the surfacing device to the planarizing medium.

40. The method of claim 39 wherein receiving instructions to activate the surfacing device to transmit a non-abrasive energy against the planarizing medium further comprises receiving a signal indicating that the workpiece is at least approximately planar.

41. The method of claim 39 wherein receiving instructions to activate the surfacing device to transmit a non-abrasive energy against the planarizing medium further comprises receiving instructions that cause the surfacing device to impart the non-abrasive energy after planarizing a high density workpiece and before planarizing a low density workpiece.

42. The method of claim 39 wherein transmitting the non-abrasive energy against the planarizing medium further comprises generating ultrasonic waves toward the planarizing medium.

43. The method of claim 39 wherein transmitting the non-abrasive energy against the planarizing medium further comprises emitting a laser beam toward the planarizing medium.

44. The method of claim 39 wherein transmitting the non-abrasive energy against the planarizing medium further comprises directing a high velocity water stream toward the planarizing medium.

45. A method of planarizing a microelectronic workpiece, comprising:

pressing a surface of a microelectronic workpiece against a planarizing surface of a planarizing medium;

moving the microelectronic workpiece and/or the planarizing medium relative to one another to rub the workpiece against the planarizing surface; and transmitting ultrasonic energy against the planarizing medium while rubbing the workpiece against the planarizing surface, wherein transmitting the ultrasound energy is initiated based upon an input of a topography of the workpiece.

46. The method of claim 45 further comprising receiving instructions to transmit the ultrasonic energy against the planarizing medium, wherein transmitting the ultrasound energy is initiated based upon receiving a signal indicating that the workpiece is at least approximately planar.

47. The method of claim 45 further comprising receiving instructions to transmit the ultrasonic energy against the planarizing medium after planarizing a high density workpiece and before planarizing a low density workpiece.

48. A method of planarizing a microelectronic workpiece, comprising:

pressing a microelectronic workpiece against a planarizing surface of a planarizing medium;

moving the microelectronic workpiece and/or the planarizing medium relative to one another to rub the workpiece against the planarizing surface;

receiving input from a planarity detection system that the workpiece is at least approximately planar; and activating an ultrasonic transducer to transmit ultrasonic energy toward the planarizing medium after receiving input from the planarity detection system.

49. A method of planarizing a microelectronic workpiece, comprising:

pressing a surface of a microelectronic workpiece against a planarizing surface of a planarizing medium;

moving the microelectronic workpiece and/or the planarizing medium relative to one another to rub the workpiece against the planarizing surface;

receiving instructions to activate an ultrasonic transducer to transmit ultrasonic energy against the planarizing medium while rubbing the workpiece against the planarizing surface based upon a topography of the workpiece; and activating the ultrasonic transducer to transmit ultrasonic energy against the planarizing medium.

50. The method of claim 49, wherein receiving instructions comprises receiving a signal from a planarity detection system that the workpiece is at least approximately planar.

51. A method of planarizing a microelectronic workpiece, comprising:

planarizing a high density workpiece by pressing a surface of the high density workpiece against a fixed-abrasive pad;

moving the workpiece and/or the fixed-abrasive pad relative to one another to rub the workpiece against the pad;

imparting a non-abrasive energy toward the fixed-abrasive pad after planarizing the high density workpiece; and planarizing a low density workpiece on the fixed-abrasive pad after planarizing the high density workpiece.

52. A method of planarizing a microelectronic workpiece, comprising:

planarizing a high density workpiece by pressing a surface of the high density workpiece against a fixed-abrasive pad;

moving the workpiece and/or the fixed-abrasive pad relative to one another to rub the workpiece against the pad;

impinging ultrasonic energy against the fixed-abrasive pad after planarizing the high density workpiece; and planarizing a low density workpiece on the fixed-abrasive pad after planarizing the high density workpiece.

* * * * *